US006439176B1

(12) United States Patent
Payne et al.

(10) Patent No.: US 6,439,176 B1
(45) Date of Patent: Aug. 27, 2002

(54) CONTROL SYSTEM FOR DEACTIVATION OF VALVES IN AN INTERNAL COMBUSTION ENGINE

(75) Inventors: Natalie Payne, Rochester; David McCarthy, Churchville; Tammy Stewart (Petronis), Batavia, all of NY (US), .

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/799,301

(22) Filed: Mar. 5, 2001

(51) Int. Cl.[7] ..... F01L 9/02

(52) U.S. Cl. ..... 123/90.12; 123/90.11; 123/90.15; 123/90.33; 123/90.38

(58) Field of Search ..... 123/90.12, 198 F, 123/90.11, 90.15, 90.16, 90.33, 90.38, 193.3

(56) References Cited

U.S. PATENT DOCUMENTS 1,872,141 A * 8/1932 Hallett
5,086,803 A * 2/1992 Nakajima ..... 137/270
5,970,956 A * 10/1999 Sturman ..... 123/508

FOREIGN PATENT DOCUMENTS

DE 3300763 A1 * 7/1984 ..... 123/90.12
JP 59122714 A * 7/1984 ..... 123/90.17

* cited by examiner

*Primary Examiner*—Thomas Denion
*Assistant Examiner*—Ching Chang
(74) *Attorney, Agent, or Firm*—John VanOphem

(57) ABSTRACT

A hydraulic control system for controllably directing pressurized engine oil to deactivation valve lifters to activate or deactivate the associated engine intake and exhaust valves. Passages to the lifters are controllably opened or closed by a solenoid control valve responsive to signals from a computerized engine control system. Preferably, the hydraulic control system includes a top plate having a first pattern of channels and bores formed in its underside, and a bottom plate having a second such pattern formed in its upper surface. The top and bottom plates are joined to form a hydraulic distribution manifold mounted on the engine. In a presently preferred embodiment, a gasket plate having bores and patterns of resilient gasketing material is provided between the top and bottom plates to simplify fabrication of the top and bottom plates. Solenoid control valves disposed on the bottom plate extend into the manifold to open and close respective control passages to the deactivation valve lifters upon command. A dual-purpose lead frame retainer/connector retains the control valves in the bottom plate and provides electrical connection to each control valve.

16 Claims, 11 Drawing Sheets

CONTROL SYSTEM FOR DEACTIVATION OF VALVES IN AN INTERNAL COMBUSTION ENGINE

TECHNICAL FIELD

The present invention relates to internal combustion engines; more particularly, to devices for controlling systems in an internal combustion engine; and most particularly, to a hydraulic control means for controlling the activation and deactivation of valve lifters in an internal combustion engine to engage and disengage selected cylinders from participating in the combustion of such an engine.

BACKGROUND OF THE INVENTION

Internal combustion engines are well known. Such an engine may include a plurality of combustion cylinders, each containing a reciprocable piston connected to a common crankshaft by a connecting rod. In so-called four-stroke or four-cycle engines, each cylinder is provided with one or more intake valves for admitting fuel/air mixture to the cylinder and one or more exhaust valves for exhausting burned mixture from the cylinder. A sparking plug extending into each cylinder ignites the compressed fuel/air mixture at a predetermined time relative to the rotary position of the crankshaft. Typically, the intake valves are actuated by an intake camshaft operatively connected to the crankshaft and having a plurality of cam lobes radially disposed at varying predetermined angles to cause the intake valves to open and close at the proper preselected times during rotation of the crankshaft. The exhaust valves are similarly controlled by an exhaust camshaft. In some engines, the intake and exhaust cam lobes are provided on a single, common camshaft. In an overhead valve engine, the valves may be actuated directly by camshafts disposed on the head itself, or the camshaft(s) may be disposed within the engine block and may actuate the valves via a valve train including valve lifters, pushrods, and rocker arms. In V-style engines, alternate cylinders are disposed at an included central angle from the crankshaft bearing axis such that even-number cylinders are grouped into a first cylinder bank and odd-number cylinders are grouped into a second cylinder bank. A single camshaft disposed within the engine block may actuate all the valves in both cylinder banks. The longitudinal depression between the banks of a V-style engine, and below the intake manifold, is known in the art as the engine "valley."

In most prior art four-stroke internal combustion engines, the mutual relationships of the crankshaft, camshaft, and valves are mechanically fixed; that is, the valves are opened and closed fully and identically with every two revolutions of the crankshaft, fuel/air mixture is drawn into each cylinder in a predetermined sequence, ignited by the sparking plug, and the burned residue discharged. This sequence occurs irrespective of the rotational speed of the engine or the load being placed on the engine at any given time.

It is known that for much of the operating life of a multiple-cylinder engine, the load might be met by a functionally smaller engine having fewer firing cylinders, and that at low-demand times fuel efficiency could be improved if one or more cylinders of a larger engine could be withdrawn from firing service. It is known in the art to accomplish this by de-activating the valve train leading to preselected cylinders in any of various ways, such as by providing special valve lifters having internal locks which may be switched on and off either electrically or hydraulically.

It is a principal object of the present invention to provide an improved electric/hydraulic system for controlling the hydraulic locking and unlocking of deactivatable valve lifters in an internal combustion engine.

It is a further object of the invention to provide such a system wherein trapped air is automatically purged immediately upon engine startup and is prevented from re-entry during engine operation.

It is a still further object of the invention to provide such a system comprising a minimum number of components which then may be easilyfabricated.

It is a still further object of the invention to provide such a system which can reliably activate or deactivate selected valves within the time required for one revolution of an engine's camshaft.

SUMMARY OF THE INVENTION

Briefly described, a hydraulic control system in accordance with the invention includes a hydraulic manifold assembly for controllably directing or withholding engine oil, provided under pressure by the engine oil pump, to an engine's deactivation valve lifters to activate or deactivate the associated engine intake and exhaust valves. The assembly may be conveniently disposed, for example, in the valley of a V-style engine beneath the intake manifold. Passages to the valve lifters are controllably opened or closed by an electric solenoid activation control valve, such control valves being responsive to signals from a computerized engine control system. Preferably, the hydraulic manifold assembly comprises a top plate having a first pattern of channels formed in the underside thereof, and a bottom plate having a second such pattern formed in the upper surface thereof, such that when the top and bottom plates are matably joined the appropriate manifold is formed. In a presently preferred embodiment, a gasket plate having a pattern of bores therethrough and different patterns of resilient gasketing material around the bores applied to the upper and lower surfaces of the plate, is provided between the top and bottom plates to simplify fabrication of the top and bottom plates. Alternatively, the resilient gasketing material may be applied in appropriate patterns directly to the top and bottom plates. Solenoid control valves are disposed on the underside of the bottom plate and extend therethrough into the manifold to open and close their respective control passages in the manifold upon command. A dual-purpose lead frame retainer/connector both retains the control valves in the bottom plate and provides electrical connection to each control valve.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
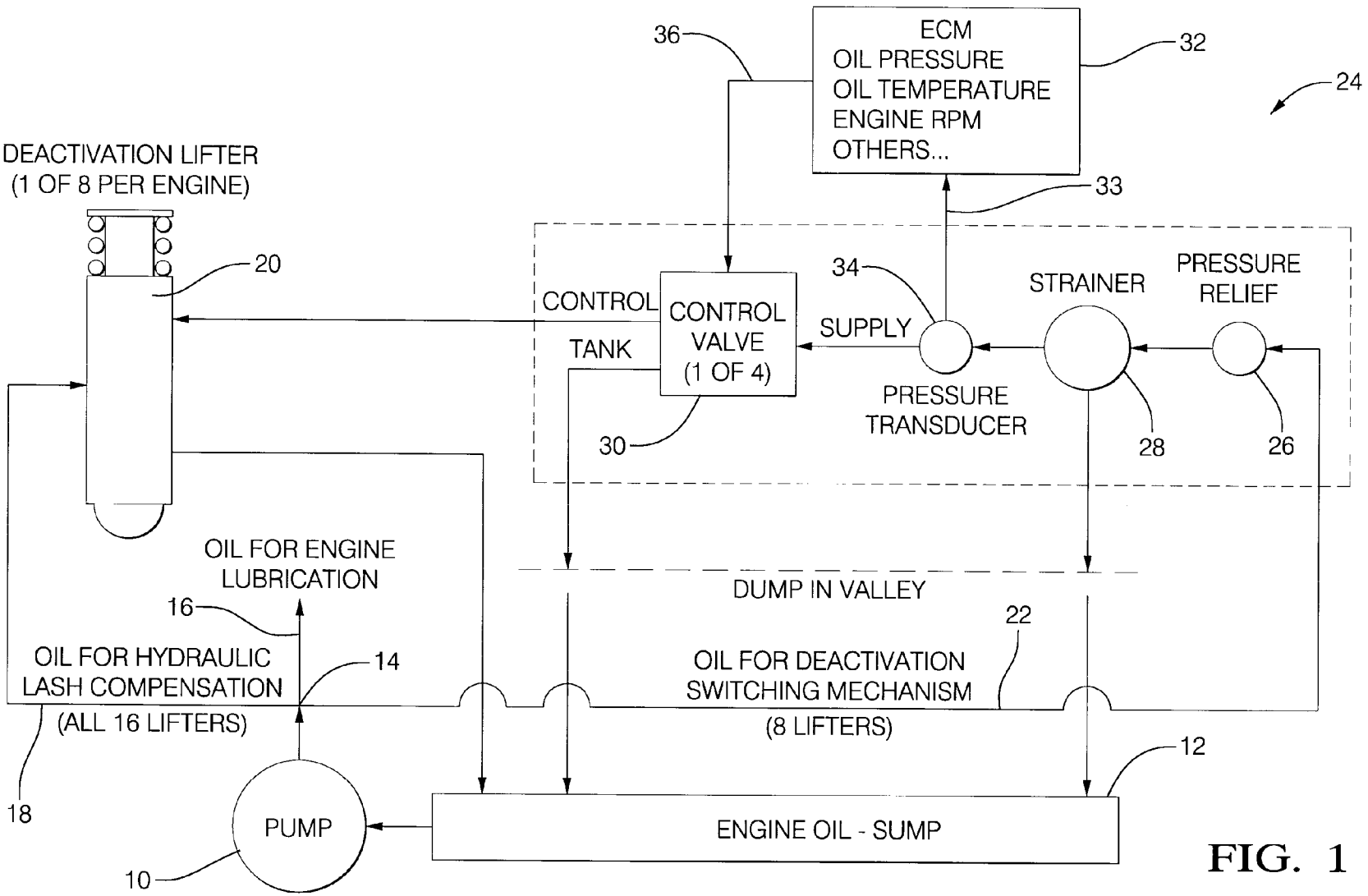
FIG. 1 is a schematic drawing of an oil system for an internal combustion engine showing the relationship of a valve deactivation control system in accordance with the invention to a prior art pressurized oil system.
Figure 2:
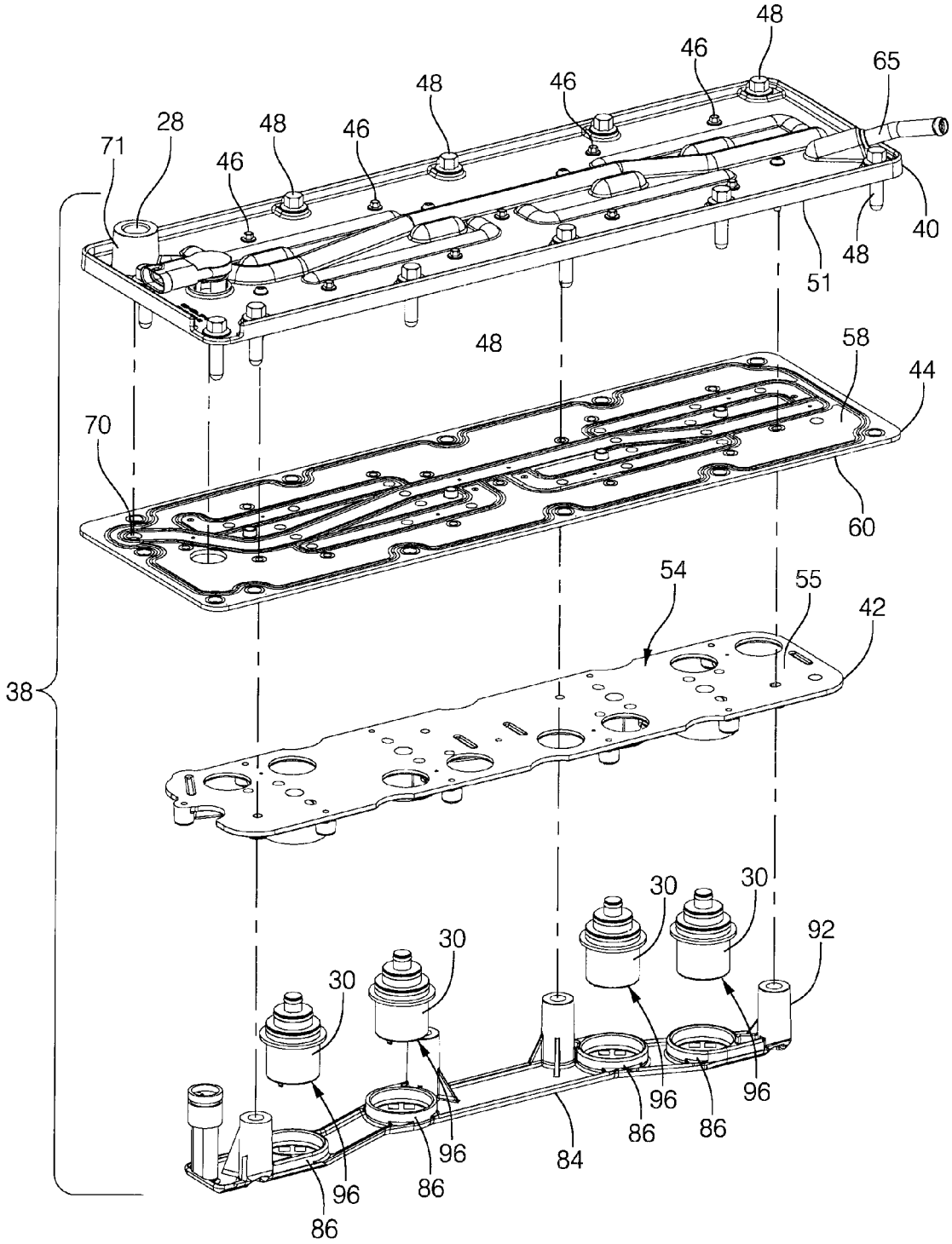
FIG. 2 is an exploded isometric view from above of a first embodiment of a hydraulic manifold assembly in accordance with the invention.
Figure 2A:
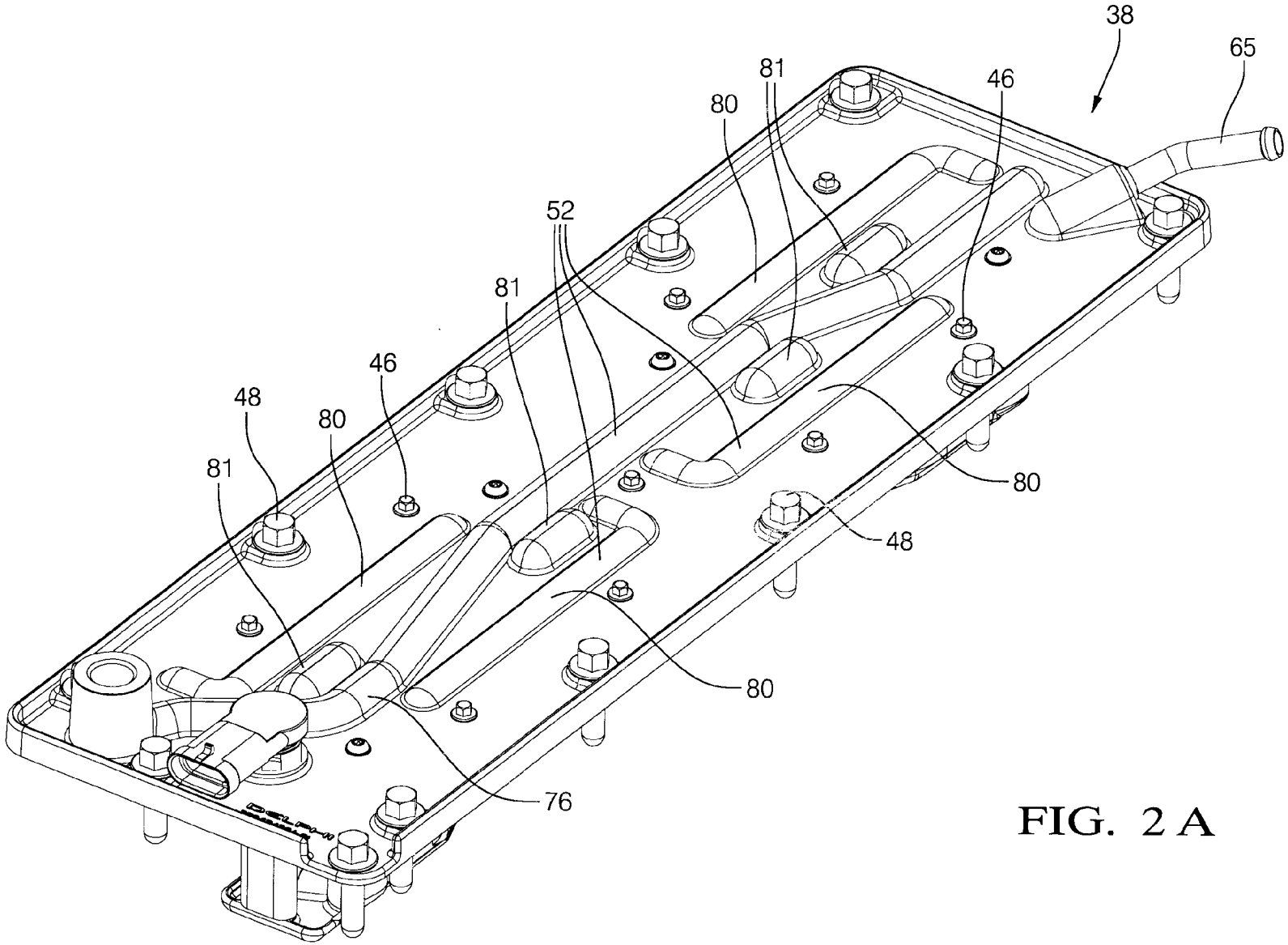
FIG. 2*a* is an assembled isometric view of the exploded components shown in FIG. 2.
Figure 3:
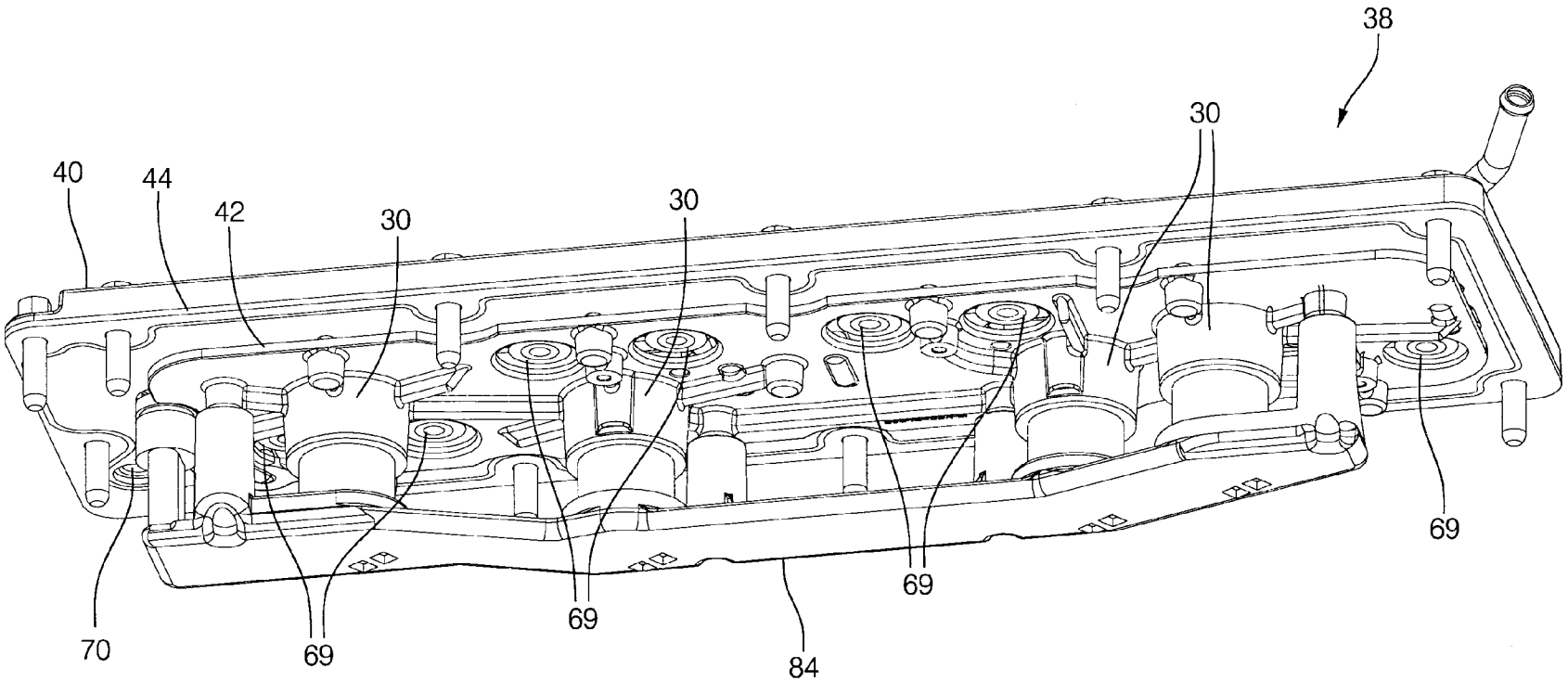
FIG. 3 is an isometric view from below of the assembly shown in FIG. 2*a;*
Figure 4:
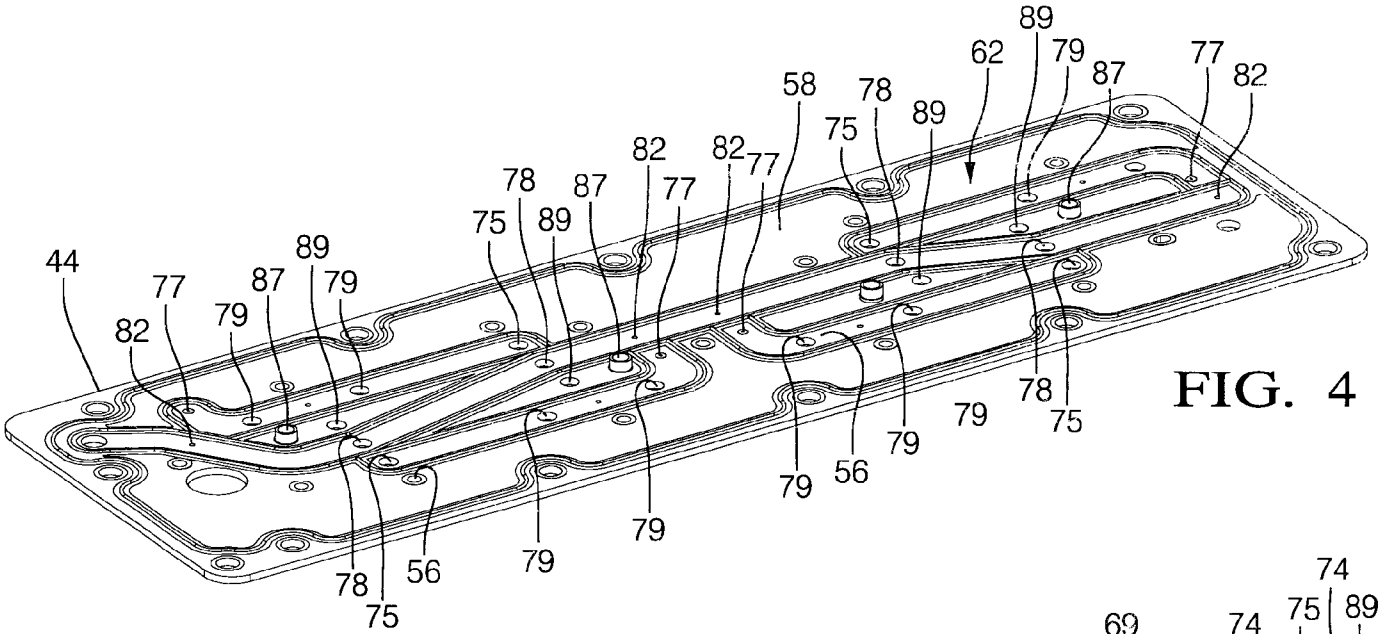
FIG. 4 is an isometric view from above of a gasket plate for use in the hydraulic manifold assembly shown in FIGS. 2*a* and 3.
Figure 5:
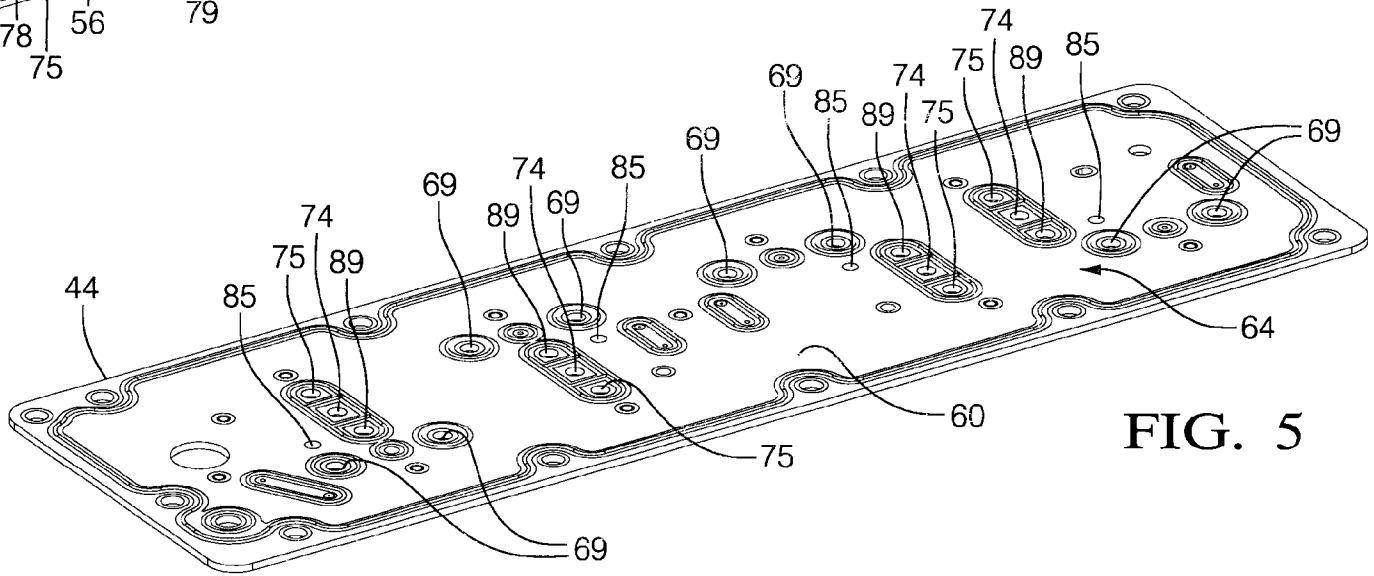
FIG. 5 is an isometric view from below of the gasket plate shown in FIG. 4.
Figure 6:
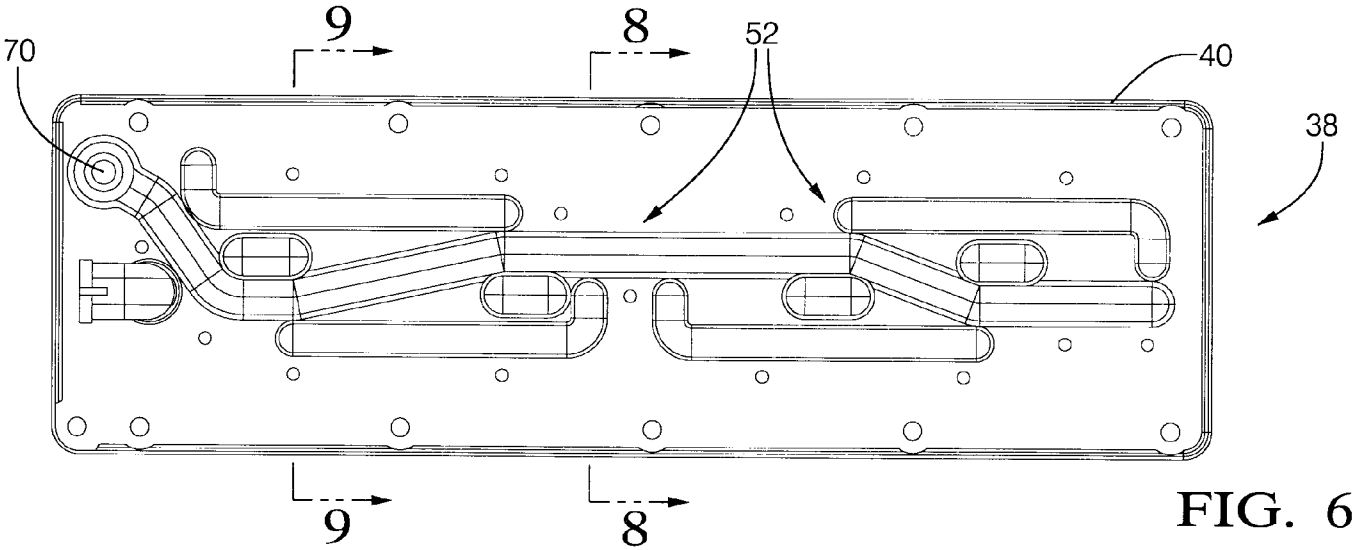
FIG. 6 is a plan view from above of the assembly shown in FIGS. 2*a* and 3.
Figure 7:
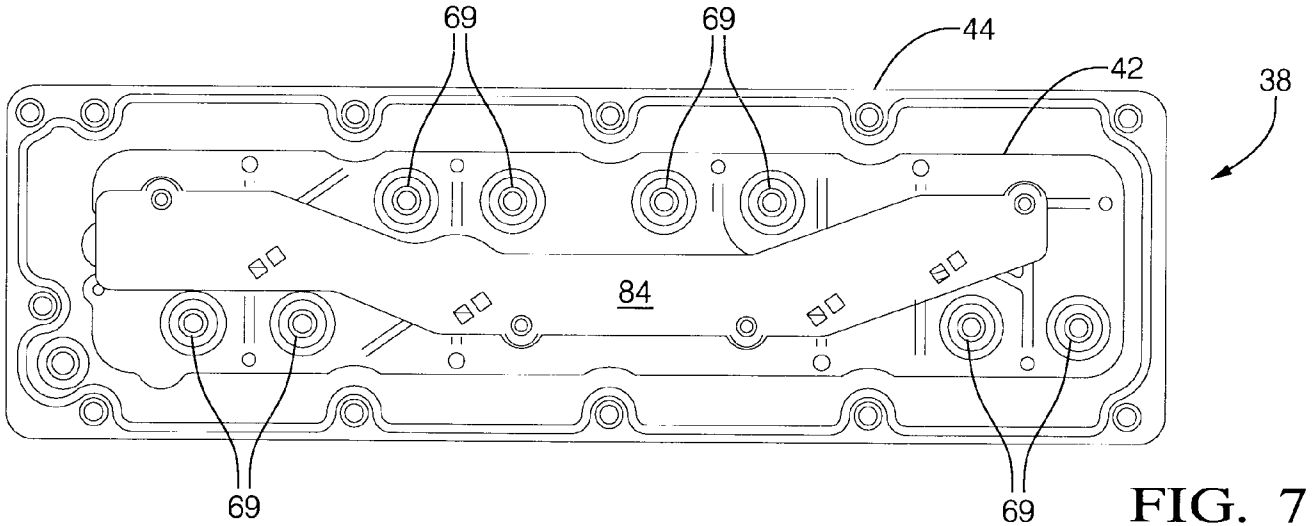
FIG. 7 is a plan view from below of the assembly shown in FIG. 6.

Referring to FIG. 1, the engine oil circuits for an internal combustion engine are provided with a valve deactivation control circuit in accordance with the invention. While only a single control valve and lifter are shown in the schematic drawing, it should be understood that valve deactivation is useful only in multiple-cylinder engines for selectively reducing the number of combusting cylinders. Multiple-cylinder embodiments are discussed below. In FIG. 1, an oil pump 10 feeds oil from sump 12 to a juncture 14 where the flow is split three ways. A first portion 16 provides conventional general lubrication to the engine. A second portion 18 provides oil conventionally to the hydraulic valve lifters 20, which are also valve deactivation lifters. A third portion 22 provides oil to a valve deactivation control system 24. An optional pressure relief valve 26 is openable to the sump to maintain pressure in system 24 at a predetermined maximum level. Oil is filtered by strainer 28 and then is supplied to a solenoid control valve 30 wherein it is either diverted to the sump 12 if the control valve 30 is not energized, or is diverted to deactivation lifter 20 if the control valve 30 is energized, to cause the associated engine intake and exhaust valves to be deactivated. An engine control module (ECM) 32, preferably mounted on other than the engine, receives input signals 33 from a pressure transducer 34 in the control system 24 and integrates via an algorithm such signals with other input operating data such as oil temperature and engine speed to provide output signals 36 to energize or deenergize solenoid control valve 30.

Referring to FIGS. 2 through 9, a first and currently preferred embodiment 38 of a valve deactivation hydraulic control circuit in accordance with the invention includes a top plate 40, a bottom plate 42, and a gasket plate 44 sandwiched between the top and bottom plates. The three plates are held together by bolts 46 to form a complex oil distribution manifold as described below. When assembled, circuit 38 may be conveniently installed into an internal combustion engine, for example, via bolts 48 extending through bores in top plate 40 and gasket plate 44 and being secured, for example, onto engine block towers provided along opposite sides of the valley of a V-style engine (not shown) for operative control of the deactivation lifters of the engine.

A first pattern of passages 50 is formed in the underside 51 of top plate 40, which may be expressed as a corresponding pattern of ridges 52 on the upper surface thereof. Similarly, a second pattern of passages 54 is formed in the upper surface 55 of bottom plate 42. Gasket plate 44 is provided with a plurality of bores 56 extending completely through the plate at selected locations for connecting passages 50 in top plate 40 with passages 54 in bottom plate 42. The upper surface 58 and the lower surface 60 of gasket plate 44 are further provided with respective patterns 62,64 of resilient gasketing material generally in the shape of the patterns of passages and bores in the top and bottom plates. Preferably, the gasketing patterns are disposed in shallow grooves 66 in surfaces 58,60 into which the gasketing material may be fully compressed when embodiment 38 is assembled.

Figure 9:
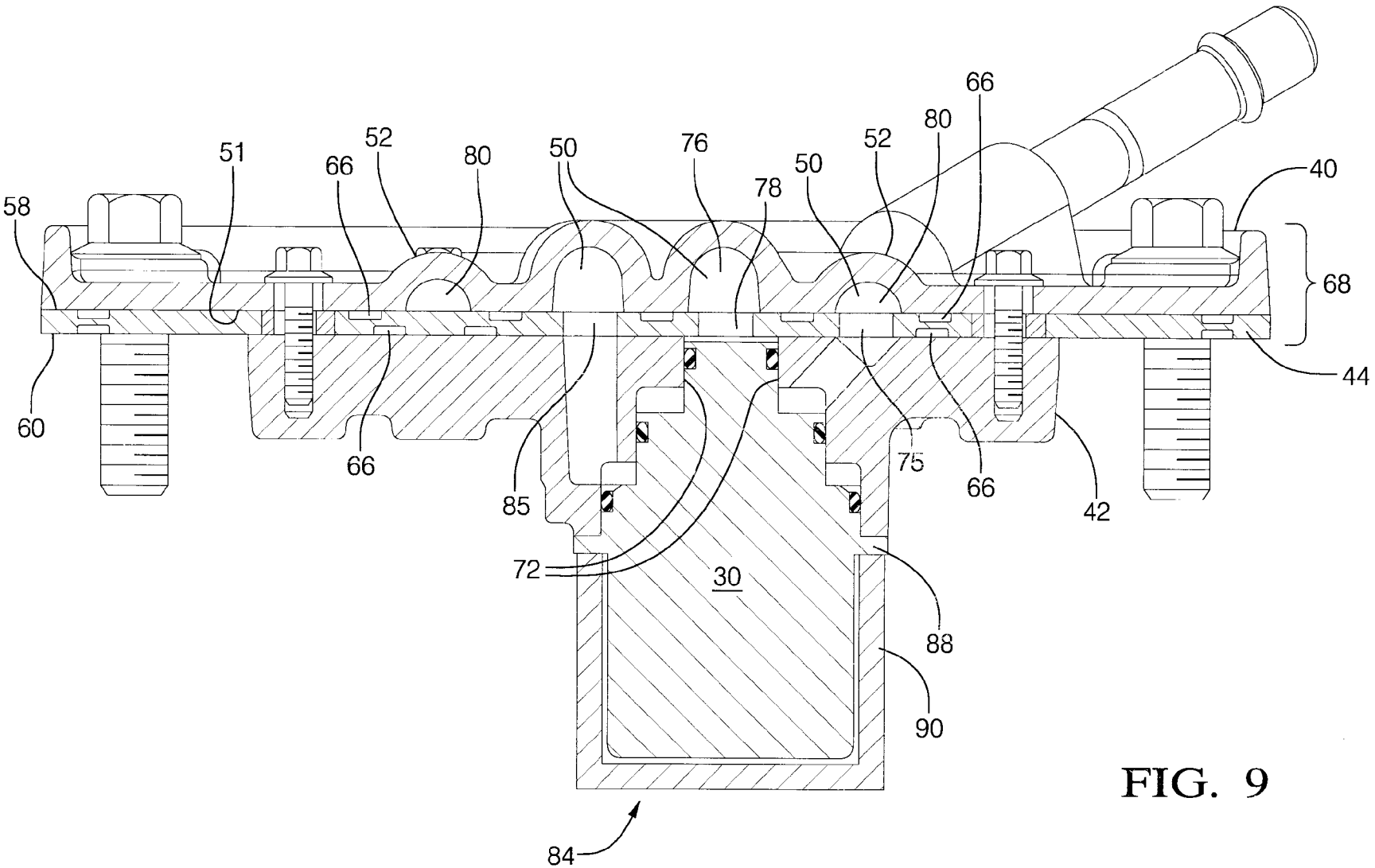
FIG. 9 is a cross-sectional view of the assembly shown in FIG. 6 taken along line 9—9.
Figure 10:
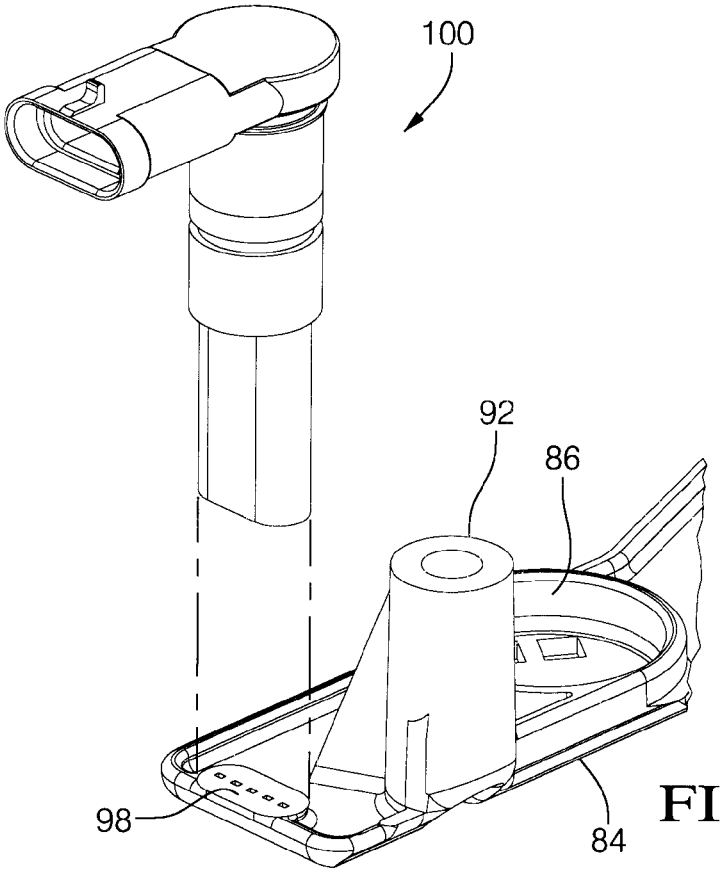
FIG. 10 is an exploded isometric view from above of the electrical connector portion of the lead frame connector/retainer shown in FIG. 3.
Figure 11:
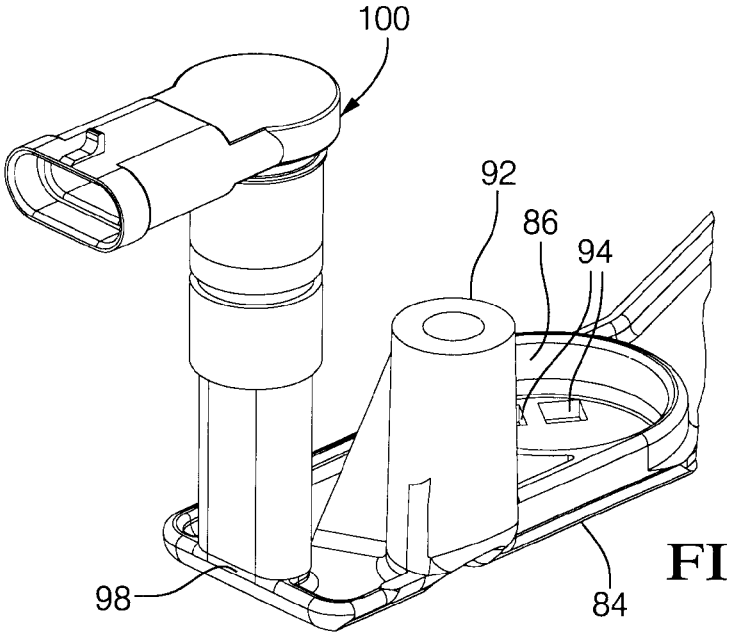
FIG. 11 is an assembled isometric view of the connector/retainer shown in FIG. 10.

The oil passages and gasketing patterns in plates 40,42,44 cooperate to define and form the oil galleries of a complex three dimensional hydraulic manifold 68 for selectively distributing pressurized oil from an oil riser 70 to each of four solenoid control valves 30 received in sockets 72 formed in bottom plate 42, as shown clearly in FIG. 9. Valves 30 extend through bottom plate 42 and the valve heads thereof seal against seats 74 on the underside of gasket plate 44. Each of the control valves 30 controls the activation and deactivation of all valve lifters for a given cylinder of an eight-cylinder engine via outlet ports 69 in manifold 68; thus, four control valves are required, for example, to deactivate valves for four cylinders of an eight-cylinder engine.

Oil is distributed along the manifold from riser 70 via a global supply gallery 76 which connects via bores 78 in gasket plate 44 to control valves 30 below seats 74. Riser 70 may be provided with an inline strainer housing 71 for ready replacement of strainer 28. When a valve 30 is energized to open, oil is admitted through seat 74 and upwards through plate 44 via bore 75 into an individual supply gallery 80 for supplying two deactivation valve lifters via bores 79 and associated outlet ports 69. It is highly important for proper and reliable engine response that galleries 80 be entirely free of air when valves 30 are called upon to provide pressure to their respective deactivation lifters. During periods of engine shutdown, the galleries in manifold 68 tend to drain by gravity to sump 12 via bore 75 which is then connected to a drain port through valve 30, the oil being replaced by air. It is highly undesirable to purge such air through the lifters upon startup; therefore, a fill path is provided for each of galleries 80. Bypass ports 82 are provided through gasket plate 44 in global supply gallery 76 leading via bypass orifices 77 into each of the individual galleries 80 to fill galleries 80 and the lines leading to the deactivation lifters (not shown). Oil is continually flowed, when control valve 30 is de-energized, via bore 75, through a passage in valve 30, and up through bore 85 into return gallery 81. The entry to each of galleries 81 includes a cylindrical weir 87 extending above gasket plate surface 58 and having an upper lip higher than the inside height of gallery 80, the return oil overflowing weir 87 and returning to sump 12 via outlet bore 89 in galleries 81. This arrangement keeps gallery 80 filled with oil and thus prevents entry of air into the supply lines leading from the control valves to the deactivation lifters.

Figure 8:
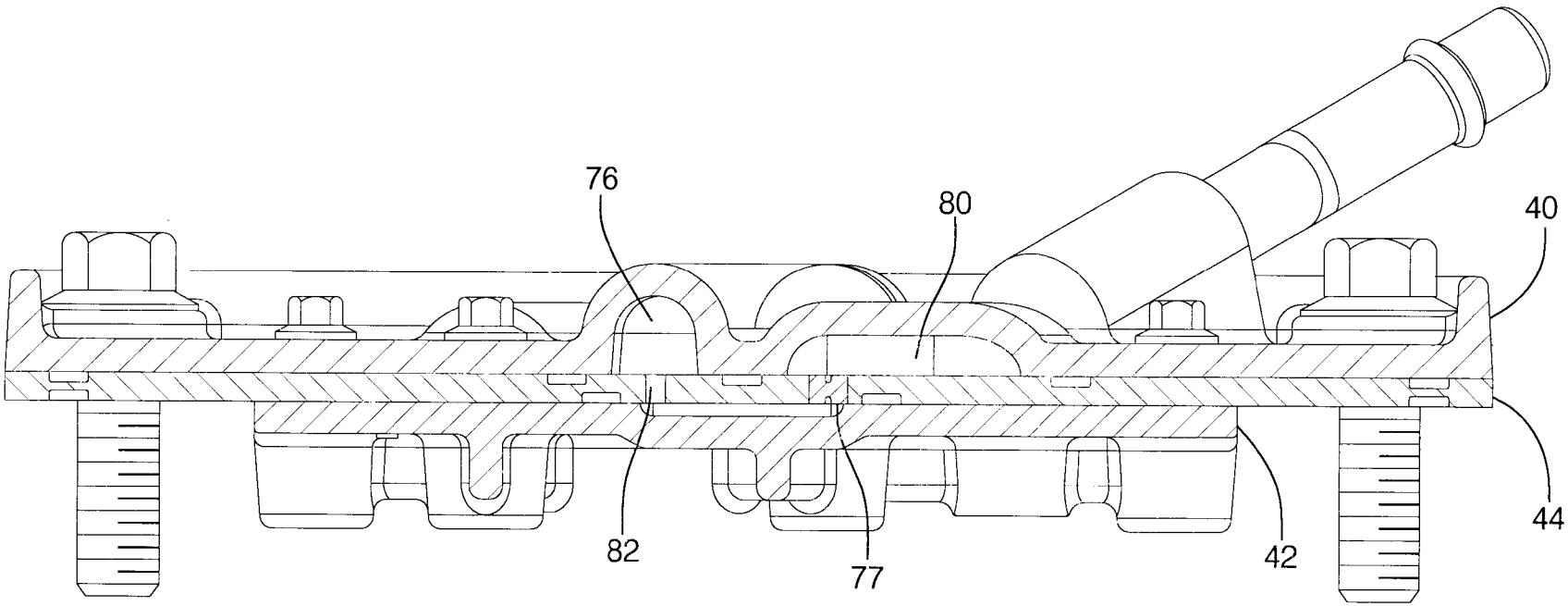
FIG. 8 is a cross-sectional view of the assembly shown in FIG. 6, taken along line 8—8, the control valves and connector/retainer being omitted for clarity.

Orifices 77 must be small enough in diameter that the bypass circuits do not deprive the other engine oil circuits of oil, yet large enough that they permit rapid purging of galleries 80 and are not readily fouled by particles of contamination within the oil stream. A diameter of about 0.4mm has been found to meet both requirements. Further, the exit aperture of each orifice 77 is preferably flared outwards, as shown in FIG. 8, to assist in scavenging air from galleries 80.

Preferably, provision is made in manifold 68 for a breather pipe 65 connected to a conventional positive crankcase ventilation (PCV) valve (not shown).

It will be appreciated that other similar embodiments are possible within the scope of the invention. For example, the grooves 66 and gasketing patterns 62,64 may be applied directly to top plate surfaces 51, in which case gasket plate 44 may be omitted entirely, and a suitable manifold formed by bolting top and bottom plates 40,42 directly together. However, such embodiment is not presently preferred because it cannot provide for bypass orifices 82, although a similar channel may be incised laterally into plate 40. Similarly, oil passage patterns 50,54, presently provided in the top and bottom plates, respectively, may instead be provided along with the gasketing patterns in surfaces 58,60, respectively, of gasket plate 44, and surfaces 51,55 of the top and bottom plates may be substantially unfeatured. Such an embodiment is not presently preferred because the ridges 52 formed in top plate 40 also function as rib supports to increase desirably the stiffness of the overall assembly.

Figure 12:
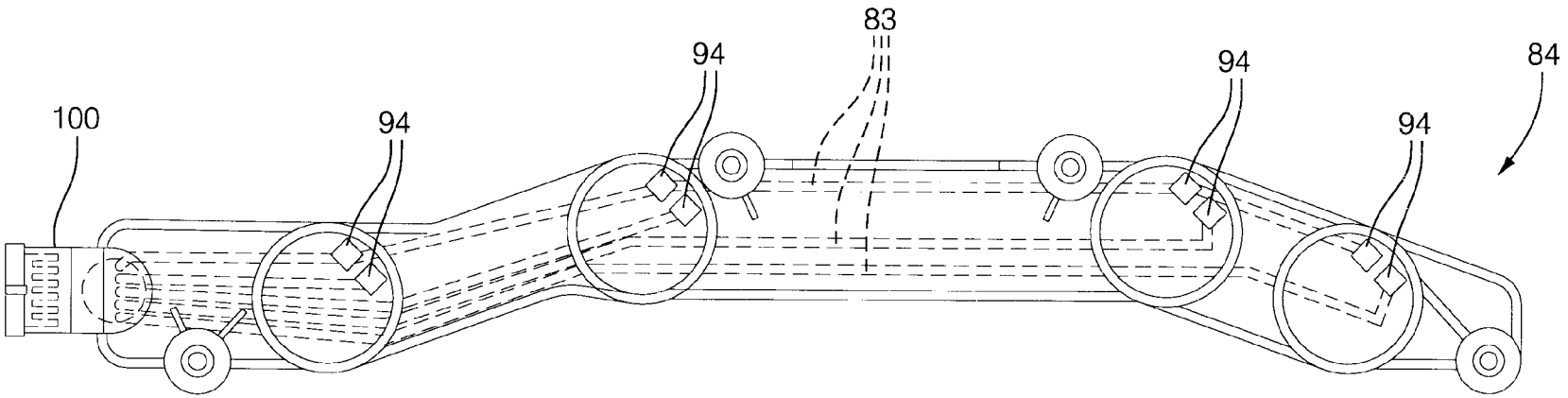
FIG. 12 is a plan view of the connector/retainer shown in FIG. 3, showing the location of electrical leads embedded therein.
Figure 13:
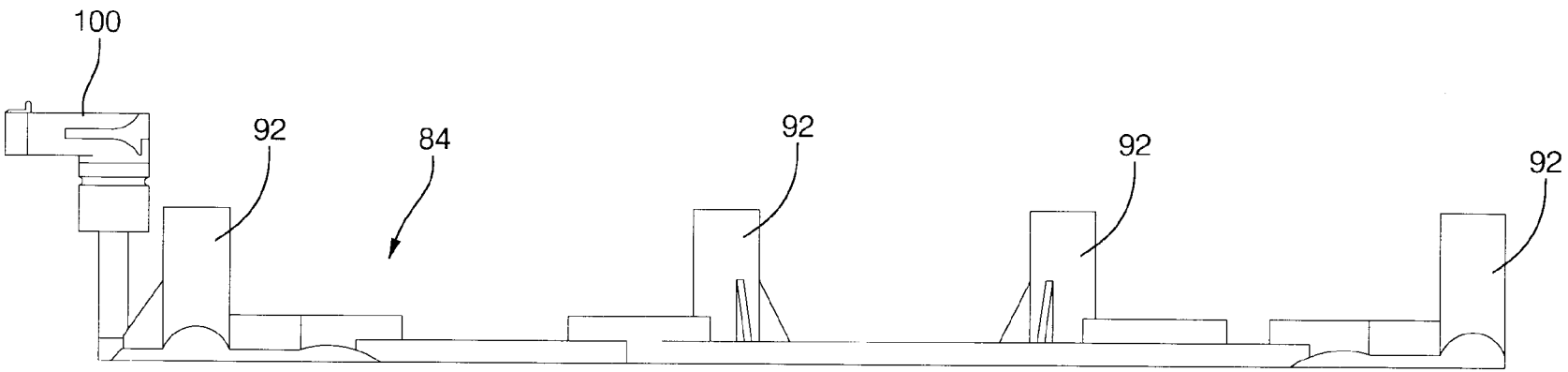
FIG. 13 is a side elevational view of the connector/retainer shown in FIGS. 3 and 12.
Figure 14:
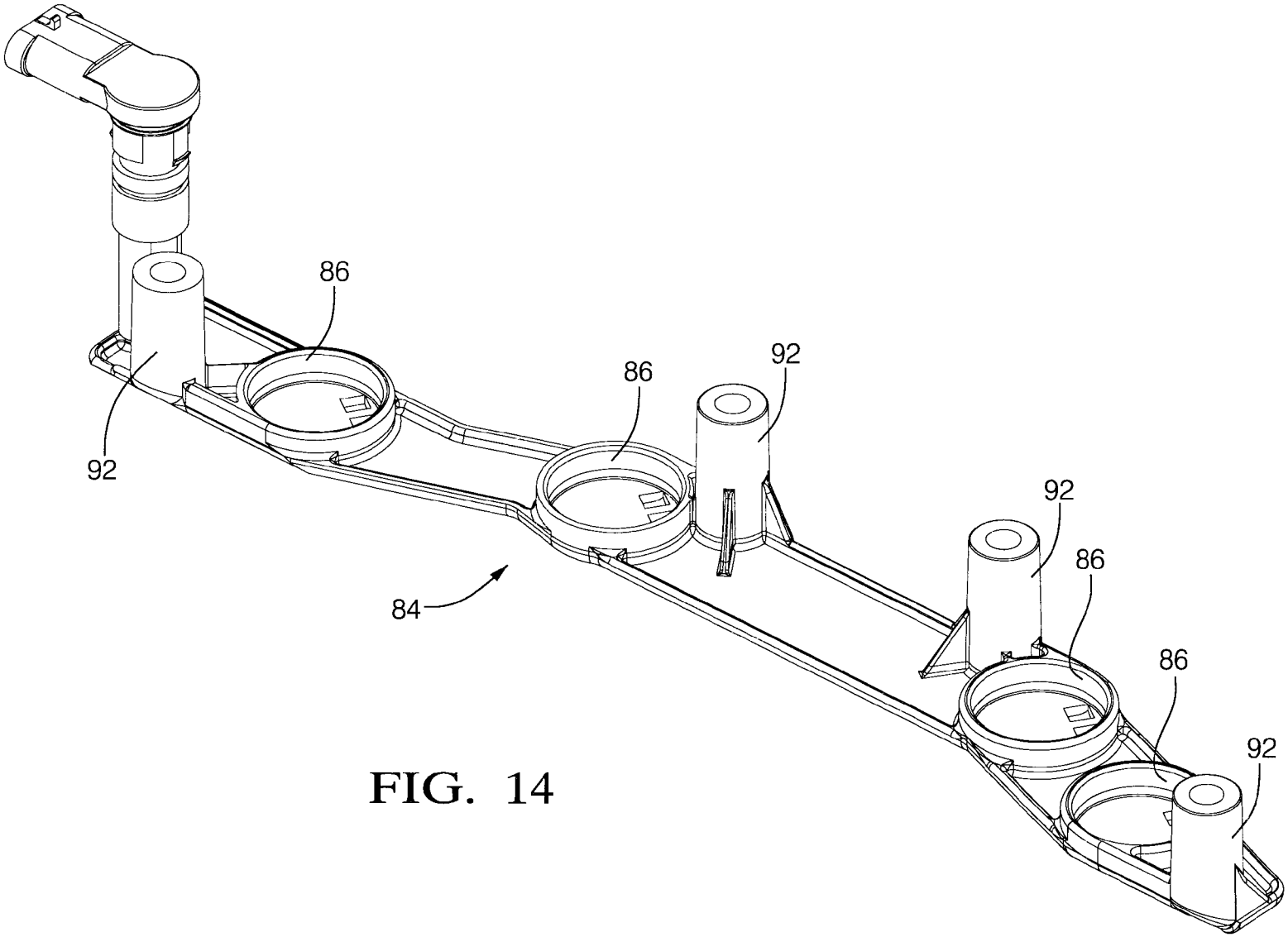
FIG. 14 is an isometric view from above of the connector/retainer shown in FIGS. 12 and 13.

Referring to FIGS. 2, 3, 7, and 9–14, a connector/retainer 84 holds the solenoid control valves 30 in their respective sockets 72 and provides electrical connection of the solenoids to the ECM 32. Connector/retainer 84 is preferably insert molded or cast of a high-temperature dielectric plastic. Two different styles of connector/retainer are shown which are functionally equivalent. The connector/retainer 84 shown in FIGS. 2, 3, 7 and 10–14 supports control valves 30 at their bases via cups 86; or, as shown in FIG. 9, at a shoulder flange 88 on the valves via deep cups 90. Connector/retainer 84 is provided with integral standoffs 92 through which it is bolted into manifold 68. As shown in FIG. 12, electrical leads 83 are cast into connector/retainer 84, terminating distally at conductive slotted tabs 94 into which connector tabs 96 on the control valves 30 (FIG. 2) are connectively inserted to provide power to the solenoids. Leads 83 terminate proximally at a female socket 98 (FIG. 10) into which a spaded connector 100 may be inserted (FIG. 11) for conventional connection of the control valves to ECM 32.

In operation, at engine start-up, typically all valve lifters are activated, all engine valves are functional, and all control valves are de-energized. Oil pump 10 via riser 70 fills global oil gallery 76 and individual oil galleries 80 via bypass orifices 77, purging entrained air through bore 75. Upon a signal sent from engine control module 32 to any one or more of control valves 30 via connector 100 and electrical leads 83, the control valve(s) is actuated, permitting pressurized oil to flow from gallery 76 past valve 30 to outlet ports 69 for passage via engine block towers (not shown) to intake and exhaust valve deactivation lifters 20 (FIG. 1). Oil continues to flow through bypass orifice 77, over cylindrical weir 87, and via return gallery 81 to sump 12. Pressure is applied continuously to the lifters while control valve 30 is actuated. Upon a deactivation signal from ECM 32, control valve 30 is closed, as by an internal spring or other conventional means (not shown), shutting off further pressure to lifters 20. Excess oil in lifters 20 is expelled to sump 12, and lifters 20 resume activation of the intake and exhaust valves.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A control system for deactivation of valves in a multiple-cylinder internal combustion engine having a pressurized oil source and hydraulically-operable deactivation valve lifters, comprising:

a) a hydraulic manifold having a plurality of oil galleries connected between said oil source and said lifters;

b) a plurality of independently-controllable solenoid control valves disposed on said manifold and extending into said galleries, said control valves being operable for activation and deaactivation of lifters associated with one or more of said cylinders by controlling the flow of pressurized oil to said associated lifters; and c) a lead frame connector/retainer mounted on said manifold for retaining said control valves in said disposition on said manifold and for carrying electrical signals to said control valves for activation and deactivation of said lifters.

2. A control system in accordance with claim 1, wherein said hydraulic manifold is an assembly comprising:

a) a top plate having a first pattern of oil passages formed in a lower surface thereof and a first pattern of resilient gasketing material disposed on said lower surface; and b) a bottom plate having a second pattern of oil passages formed in an upper surface thereof and a second pattern of reslient gasketing material disposed on said upper surface;

wherein said lower and upper surfaces are matably joined to form said oil galleries.

3. A control system in accordance with claim 2 wherein said lower and upper surfaces each further comprises a pattern of grooves for receiving said first and second patterns of resilient gasketing material, respectively.

4. A control system in accordance with claim 2, wherein said hydraulic manifold is an assembly comprising:

a) a top plate having a first pattern of oil passages formed in a lower surface thereof;

b) a bottom plate having a second pattern of oil passages formed in an upper surface thereof; and c) a gasket plate having a first pattern of resilient gasketing material corresponding to said first pattern of oil passages disposed on a first surface thereof, and having a second pattern of resilient gasketing material corresponding to said second pattern of oil passages disposed on a second and opposite surface thereof, and having a plurality of bores extending between said first and second surfaces;

wherein said gasket plate is matably retained between said top plate and said bottom plate to form said oil galleries.

5. A control system in accordance with claim 4 wherein said first and second surfaces of said gasket plate each further comprises a pattern of grooves for receiving said first and second patterns of resilient gasketing material, respectively.

6. A control system in accordance with claim 5 wherein said first and second patterns of gasketing material are non-identical.

7. A control system in accordance with claim 4 wherein at least one of said bores through said gasket plate is an oil bypass orifice for purging air from at least one of said galleries.

8. A control system in accordance with claim 7 wherein said bypass is orifice is flared at one of said plate surfaces to improve flushing of air from said gallery.

9. A control system in accordance with claim 4 wherein at least one of said bores through said gasket plate at its exit from said first surface is provided with a length of conduit extending beyond said first surface.

10. A control system in accordance with claim 1 wherein said lead frame connector/retainer includes electrical leads embedded in a plastic matrix.

11. A control system in accordance with claim 1, wherein said control system is configured for mounting in the engine valley of a V-style engine.

12. A control system in accordance with claim 1, wherein said hydraulic manifold is an assembly comprising:

a) a top plate;

b) a bottom plate; and c) a gasket plate having a first pattern of oil passages formed in a first surface thereof and having a first pattern of resilient gasketing material corresponding to said first pattern of oil passages disposed on said first surface, and having a second pattern of oil passages formed in a second and opposite surface thereof and having a second pattern of resilient gasketing material corresponding to said second pattern of oil passages disposed on said second and opposite surface thereof, and having a plurality of bores extending between said first and second surfaces, said second pattern of oil passages differing from said first pattern of oil passages;

wherein said gasket plate is matably retained between said top plate and said bottom plate to form said oil galleries.

13. A control system in accordance with claim 4 wherein at least one of said top plate, said bottom plate, and said gasketing plate is formed from a material selected from the group consisting of metals and plastics.

14. A multiple-cylinder internal combustion engine having a system for deactivation of engine valves, the engine comprising:

a) a deactivation valve lifter for each valve to be deactivatable;

b) an engine control module for controlling the activation and deactivation of said valve lifters;

c) a source of pressurized oil; and d) a valve deactivation control system disposed in said engine between said valve lifters and said engine control module, said system including i) a hydraulic manifold having a plurality of oil galleries connected between said oil source and said lifters;

ii) a plurality of independently-controllable solenoid control valves disposed on said manifold and extending into said galleries, a one of said control valves being operable for activation and deactivation of lifters associated with each one of said cylinders by controlling the flow of pressurized oil to said associated lifters; and iii) a lead frame connector/retainer mounted on said manifold for retaining said control valves in said disposition on said manifold and for providing electrical signals to said control valves for activation and deactivation of said lifters.

15. A control system for use with hydraulically-actuated deactivation valve lifters, comprising:

a hydraulic manifold including a top plate, said top plate having a lower surface, said lower surface defining an upper portion of a first pattern of oil passages, a bottom plate having an upper surface, said upper surface defining a lower portion of a second pattern of oil passages, said top and bottom plate being connected together, oil galleries defined at least in part by said first and second pattern of oil passages;

a gasket plate having a first surface and a second surface, a first pattern of resilient gasketing material disposed on said first surface and corresponding to said first pattern of oil passages, a second pattern of resilient gasketing material disposed on said second surface and corresponding to said second pattern of oil passages, said gasket plate defining a plurality of bores extending from said first surface to said second surface, said gasket plate being disposed between said top and bottom plates, said gasket plate defining at least in part said oil galleries in conjunction with said first and second pattern of oil passages; and a lead frame connector/retainer affixed to said manifold, said lead frame including a plurality of retaining means and electrical signal carrying means.

16. The control system of claim 5, further comprising a plurality of independently-controllable solenoid control valves, each of said control valves disposed within a corresponding one of said plurality of retaining means and extending into a corresponding one of said oil galleries, each said control valve controlling the flow of fluid to a corresponding one of the deactivation valve lifters, said control valves receiving and being responsive to electrical signals from said electrical signal carrying means.

* * * * *